United States Patent [19]

Takahashi

[11] 4,332,071

[45] Jun. 1, 1982

[54] METHOD OF AND APPARATUS FOR ATTACHING END STOPS TO SLIDE FASTENER STRINGER TAPES

[75] Inventor: Kihei Takahashi, Uozu, Japan

[73] Assignee: Yoshida Kogyo, K.K., Tokyo, Japan

[21] Appl. No.: 81,117

[22] Filed: Oct. 2, 1979

[30] Foreign Application Priority Data

Oct. 5, 1978 [JP] Japan ..... 53-122961

[51] Int. Cl.[3] ..... B21D 53/56; B23P 19/04

[52] U.S. Cl. ..... 29/408; 29/767

[58] Field of Search ..... 29/243.56, 509, 515, 29/408, 766, 767, 770, 33.2

[56] References Cited

U.S. PATENT DOCUMENTS 3,445,912 5/1969 Perlman ..... 29/767 X
3,504,418 4/1970 Perlman ..... 29/767 X
3,541,662 11/1970 Perlman ..... 29/767 X

FOREIGN PATENT DOCUMENTS 751059 6/1956 United Kingdom ..... 29/243.56

*Primary Examiner*—Ervin M. Combs
*Attorney, Agent, or Firm*—Robert E. Burns; Emmanuel J. Lobato; Bruce L. Adams

[57] ABSTRACT

An apparatus for attaching a pair of U-shaped end stops each having a pair of opposed clinching legs to the respective longitudinal marginal edge portions of a pair of slide fastener stringer tapes comprises a guide block provided with a pair of elongate slots in which are slideably mounted a pair of punches. The U-shaped end stops are slideably positioned in respective ones of the slots and are orientated such that the two legs are in slideable engagement with the slot walls and the ends of the legs face toward the pair of stringer tapes. The slots are provided with shoulders configured to engage with one of the legs of the end stops to effect turning of the end stops about the shoulders in response to movement of the end stops by the punches to thereby position the two legs of the U-shaped end stops on opposite sides of the stringer tape. Further movement of the punches effects clinching of the legs of the end stops to the stringer tapes. A method of attaching a pair of U-shaped end stops each having a pair of clinching legs to the respective longitudinal marginal edge portions of a pair of slide fastener stringer tapes comprises the steps of intermittently advancing the slide fastener stringer tapes lengthwise along a path of travel; delivering the U-shaped end stops toward the stringer tapes individually in a direction substantially normal to the path of travel of the stringer tapes with the end stop legs directed toward the path of travel; stopping the individual end stops short of the stringer tapes and retaining one of the legs of each end stop as an axis for rotation of the end stop; turning the individual end stops about one of its legs so as to place the legs of each end stop one over and the other below the longitudinal marginal edge portions of the stringer tapes with spaces left between both the legs and the longitudinal marginal edge portions; and clinching the legs about the longitudinal marginal edge portions while the stringer tapes are at rest.

14 Claims, 11 Drawing Figures

METHOD OF AND APPARATUS FOR ATTACHING END STOPS TO SLIDE FASTENER STRINGER TAPES

BACKGROUND OF THE INVENTION

1. Field of the Invention

The present invention relates to a method of and an apparatus for attaching an end stop to a slide fastener stringer tape.

2. Prior Art

A wide variety of methods and apparatus have been proposed for attaching end stops to longitudinally spaced, coupling element-free portions of the longitudinal beaded edge of a slide fastener stringer tape. For the application of U-shaped end stops having a pair of clinching legs, it has been customary to spread apart a pair of stringer tapes at their opposed coupling element-free portions, to erect the stringer tapes so that their beaded edge portions are directed upwardly, and to apply a pair of end stops to the stringer tapes with the end stop legs clinched about the beaded edge portions. With such a prior art arrangement, however, feeding and positioning of the stringer tapes has to be carried out in a complicated operation, which needs a complex mechanism so as to be effected.

SUMMARY OF THE INVENTION

It is an object of the present invention to provide a method of attaching an end stop to a slide fastener stringer tape in a simple operation.

Another object of the present invention is to provide an apparatus for attaching an end stop to a slide fastener stringer tape, the apparatus being simple in structure.

According to a method of the present invention, an end stop having a pair of clinching legs is moved toward a stringer tape with the clinching legs directed toward the stringer tape. The end stop is then turned about one of its clinching legs so that the legs are placed one on each side of a longitudinal marginal edge portion of the stringer tape, whereupon the legs are clinched about the longitudinal tape edge portion. A flat piece of metal is shaped into the end stop, before it is moved toward the stringer tape.

According to an apparatus of the present invention, a guide block supported on a frame has a slot in which an end stop is axially driven by a punch toward an anvil recess in an anvil block mounted on the frame, the guide block having a shoulder on a wall defining the slot. The anvil block supports a stringer tape so that a longitudinal marginal edge portion thereof is located over the anvil recess. On the movement of the end stop driven by the punch through the vertical slot, one of a pair of clinching legs of the end stop is engaged by the shoulder, and then the end stop is turned about said one of the clinching legs so that the legs are placed one on each side of the longitudinal tape edge portion. Continued driving movement of the punch causes the clinching legs to be clinched about the longitudinal tape edge portion.

BRIEF DESCRIPTION OF THE DRAWINGS

The above and other objects and advantages of the present invention will become apparent from the following detailed description when taken in conjunction with the accompanying drawings, in which.

DETAILED DESCRIPTION OF THE PREFERRED EMBODIMENT

Figure 1:
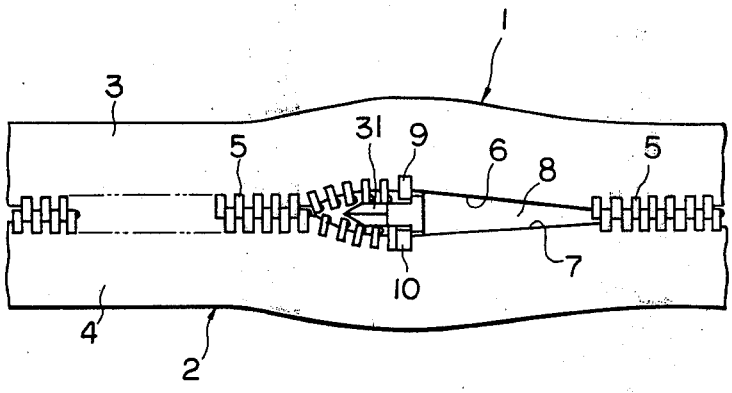
FIG. 1 is a fragmentary plan view of a pair of slide fastener stringers to which a pair of end stops are attached, respectively, in accordance with a method of the present invention.

FIG. 1 shows a pair of coupled slide fastener stringers 1, 2 comprising a pair of elongate stringer tapes 3, 4, respectively, and a plurality of longitudinally spaced chains 5 comprised of interengaged rows of coupling elements mounted on the opposed longitudinal marginal beaded edge portions 6, 7 of the respective stringer tapes 3, 4. The slide fastener stringers 1, 2 jointly have a plurality of coupling element-free gaps or spaces 8 each interposed between adjacent ones of the longitudinally spaced chains 5.

Figure 2:
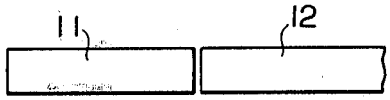
FIG. 2 is an enlarged plan view of a flat piece of metal from which an end stop is to be made.
Figure 3:
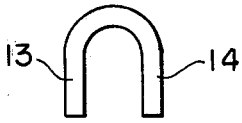
FIG. 3 is an enlarged front elevation view of an end stop.

A pair of end stops 9, 10 are attached to the beaded edge portions 6, 7, respectively, at one end of each of the coupling-element-free spaces 8 and are aligned with each other transversely of the slide fastener stringers 1, 2. Each end stop 9, 10 is made from a flat blank piece 11 of metal (FIG. 2) cut off from an elongate metal piece 12. The flat blank piece 11 is bent over about its central portion and shaped into the form of a U having a pair of parallel, spaced clinching legs 13, 14 (FIG. 3), to serve as the end stop 9, 10.

Figure 4:
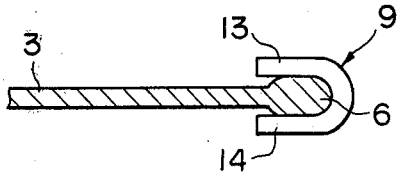
FIG. 4 is an enlarged transverse cross section view of a slide fastener stringer with an end stop being mounted on a longitudinal edge thereof.

FIG. 4 illustrates one of the end stops 9 installed on the stringer tape 3 with the clinching legs 13, 14 placed one on each side of the longitudinal beaded edge portion 6 of the tape 3.

Figure 5:
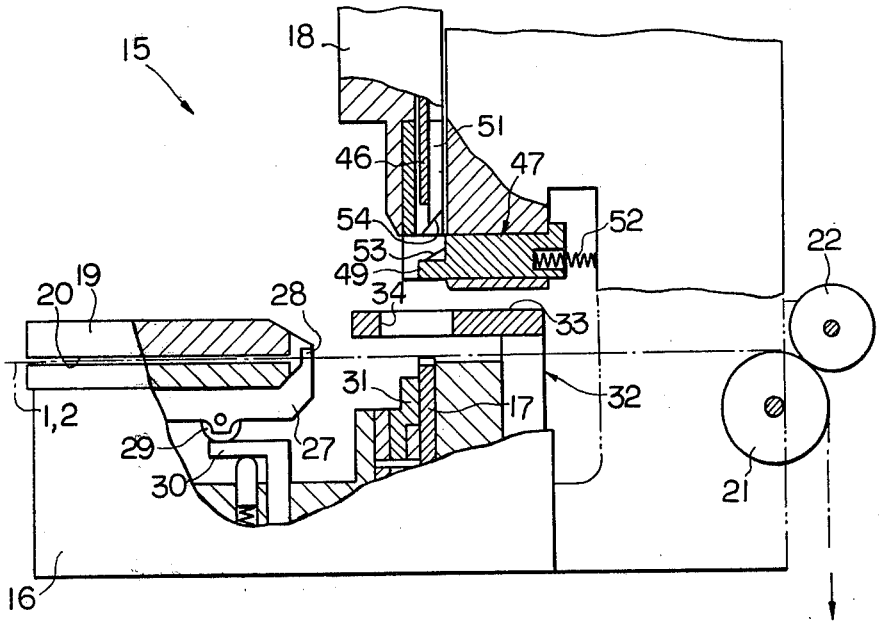
FIG. 5 is a front elevation view, with portions in cross section, of an end stop attaching apparatus according to the present invention.

An end-stop-attaching apparatus 15 shown in FIG. 5 generally comprises a frame 16, an anvil block 17 mounted on the frame 16, and a guide block 18 mounted on the frame 16 for vertical movement toward and away from the anvil block 17. A stringer guide 19 is mounted on the frame 16 at its lefthand side as shown. The stringer guide 19 has a horizontal slot 20 for the passage of the slide fastener stringers 1, 2.

Figure 7:
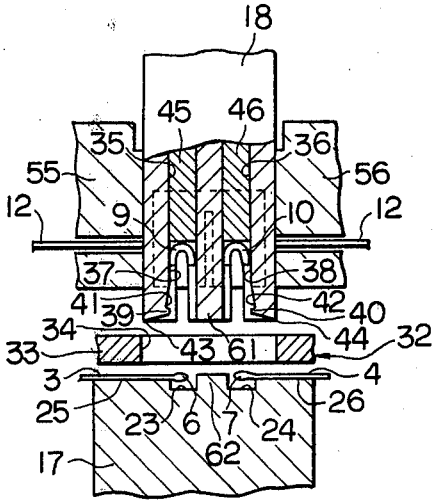
FIG. 7 is a view similar to FIG. 6, showing the position of the parts in which a pair of end stops are ready for being driven toward a die means.

As best shown in FIG. 7, the anvil block 17 has a pair of anvil recesses 23, 24 which open upwardly toward the guide block 18 and are spaced from each other in the direction transverse of the slide fastener stringers 1, 2 extending between the stringer guide 19 and the rollers 21, 22. The anvil block 17 also has a pair of substantially horizontal upper surfaces 25, 26 for supporting the stringer tapes 3, 4 thereon with the longitudinal beaded tape edge portions 6, 7 located over the anvil recesses 23, 24, respectively.

As illustrated in FIG. 5, a detector 27 for detecting a coupling-element-free space 8 in the coupled slide fastener stringers 1, 2 is pivotally and horizontally movably supported on the frame 16. The detector 27 has an upwardly directed pawl 28 and a roller 29 rotatably riding on a spring-loaded lever 30. The detector 27 is urged by the spring-loaded lever 30 normally upwardly to cause the pawl 28 to engage a chain 5 of the slide fastener stringers 1, 2 from below.

A chain splitter or separator 31 (FIGS. 1 and 5) is mounted on the frame 16 for vertical movement toward and away from the slide fastener stringers 1, 2. A stringer holder 32 (FIGS. 5 and 7) is vertically movably supported on the frame 16 and includes a horizontal presser 33 having an opening 34.

The slide fastener stringers 1, 2 are moved along a horizontal path of travel by rotation of the rollers 21, 22. When one of the coupling element-free spaces 8 comes out of the slot 20 in the stringer guide 19, the pawl 28 moves upwardly into said one of the spaces 8 under the force of the spring-loaded lever 30. Continued rotation of the rollers 21, 22 causes an end of a following one of the chains 5 to engage the pawl 28 and to move the detector 27 forwardly with the slide fastener stringers 1, 2. When the detector 27 is moved a predetermined distance, it engages a limit switch (not shown), which is then actuated to stop the rotation of the rollers 21, 22. At the same time, the actuation of the limit switch causes the chain splitter 31 to move upwardly and spread the slide fastener stringers 1, 2 apart from each other (FIG. 1), and also causes the stringer holder 32 to move downwardly until the horizontal presser 33 engages and holds the slide fastener stringers 1, 2 in place on the anvil block 17.

Figure 6:
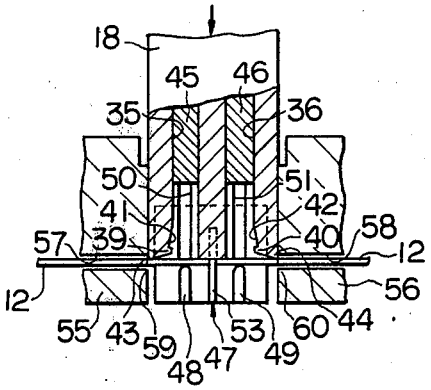
FIG. 6 is an enlarged vertical cross-section view of a guide block and end stop shaping means, showing the position of the parts in which a pair of metal pieces are ready for being shaped into a pair of end stops.

As shown in FIGS. 6 and 7, the guide block 18 has a pair of substantially vertical slots 35, 36 extending parallel to each other in registration with the anvil recesses 23, 24, respectively. The slots 35, 36 have open ends facing downwardly toward the anvil recesses 23, 24 respectively. The guide block 18 has a pair of respective vertical walls 37, 38 defining the corresponding slots 35, 36 and facing toward each other. A pair of shoulders 39, 40 are disposed respectively on the walls 37, 38 and are located adjacent to the open ends of the vertical slots 35, 36. The walls 37, 38 have a pair of recesses 41, 42 contiguous to the shoulders 39, 40, respectively. The guide block 18 has a pair of corners 43, 44 that act as blades for cutting off blank metal strips as will be described later.

A pair of punches 45, 46 are vertically movably disposed respectively in the slots 35, 36.

A slide 47 (FIG. 5) is horizontally movably supported on the frame 16 and has a pair of spaced bender projections 48, 49 (FIGS. 6 and 7) that are in vertical alignment with a pair of respective grooves 50, 51 in the guide block 18 which extend along and communicate with the respective vertical slots 35, 36. The slide 47 is normally urged by a spring 52 (FIG. 5) in a direction to cause the bender projections 48, 49 to extend into the slots 35, 36 through the grooves 50, 51, respectively.

The slide 47 has a cam follower 53 located between the bender projections 48, 49 and disposed for slidable engagement with an inclined cam surface 54 (FIG. 5) on the guide block 18.

As shown in FIGS. 6 and 7, a pair of opposite guide arms 55, 56 mounted on the frame 16 guide the vertical movement of the guide block 18 therebetween. The guide arms 55, 56 have a pair of respective feeding slots 57, 58 extending horizontally in a direction transverse to the slide fastener stringers 1, 2 for the passage therethrough of a pair of the elongate metal strips 12, 12, respectively. The guide arms 55, 56 have a pair of corners 59, 60 acting as blades which cooperate with the corners 43, 44, respectively, of the guide block 18 in severing the elongate metal strips 12, 12.

The pair of elongate metal strips 12, 12 are inserted from opposite sides into the feeding slots 57, 58 until the strips 12, 12 abut against the cam follower 53, as illustrated in FIG. 6. Then, the guide block 18 is lowered to enable the corners 43, 44 to shear the metal strips 12, 12 on the corners 59, 60 of the guide arms 55, 56. Continued downward movement of the guide block 18 causes flat blank pieces thus cut off to be bent on the bender projections 48, 49, respectively, in cooperation with the vertical slots 35, 36. As the guide block 18 is moved downwardly, the cam surface 54 engages and pushes the cam follower 53, whereupon the slide 47 is moved horizontally against the bias of the spring 52 to thereby allow the bender projections 48, 49 to be retracted from the vertical slots 35, 36, respectively. The bent blank pieces, which serve as end stops 9, 10, are thus left in the vertical slots 35, 36, and are retained therein by their legs resiliently held against the walls of the vertical slots 35, 36 (FIG. 7).

The guide block 18 includes a central leg 61 disposed between the vertical slots 35, 36. The anvil block 17 includes a central land 62 disposed between the anvil recesses 23, 24 and positioned in vertical alignment with the central leg 61 of the guide block 18. The central land 62 is higher than the upper surfaces 25, 26 of the anvil block 17, and is wider than the central leg 61 of the guide block 18.

Figure 8:
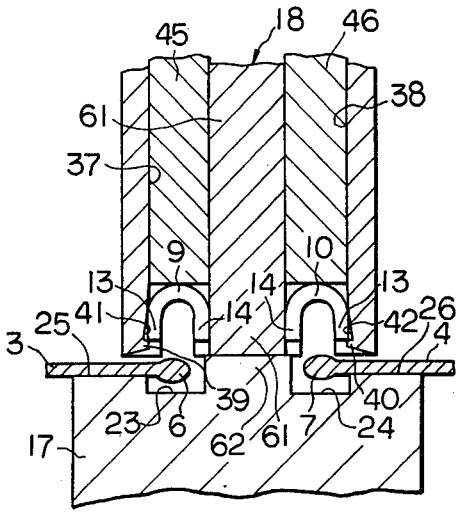
FIGS. 8 through 11 are enlarged fragmentary cross section views illustrating sequential steps of end stop attaching operation.

When the guide block 18 is lowered until the central leg 61 rests on the central land 62, (FIG. 8), the punches 45, 46 start descending to push the end stops 9, 10 downwardly. As the punches 45, 46 move downwardly, the legs 13 of the end stops 9, 10 slide resiliently against the walls 37, 38 and then are received in the recesses 41, 42, respectively.

At this time, the stringer tapes 3, 4 are placed on the upper surfaces 25, 26 with the longitudinal beaded edges 6, 7 located over the anvil recesses 23, 24, respectively. The shoulders 39, 40 are disposed over the upper surfaces 25, 26 of the anvil block 17.

Figure 9:
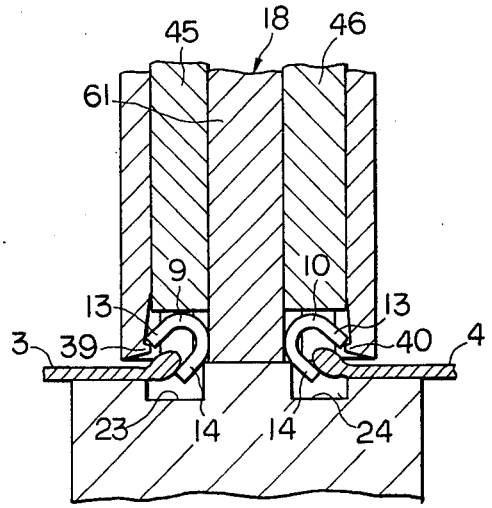
Figure 10:
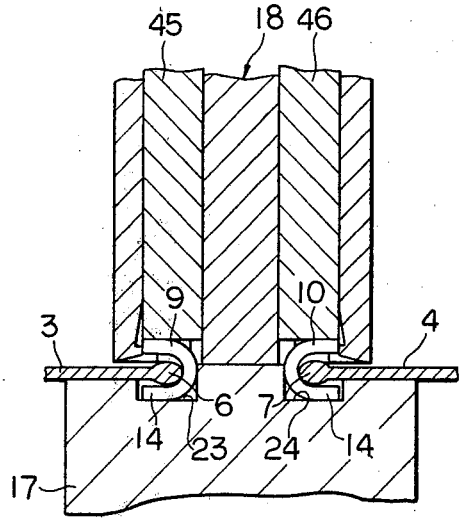
Figure 11:
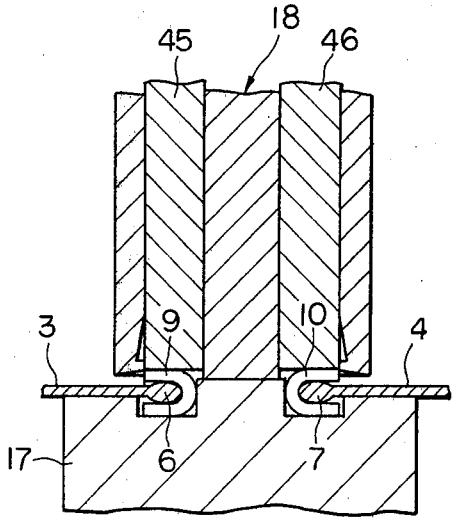

On further downward movement of the punches 45, 46, the end stops 9, 10 are turned about the legs 13 that engage the shoulders 39, 40, respectively, (FIG. 9), as the other legs 14 move into the anvil recesses 23, 24 and under the longitudinal beaded edges 6, 7 of the stringer tapes 3, 4. The end stops 9, 10 are turned through approximately 90 degrees until the legs 14 of the end stops 9, 10 are disposed on the bottoms of the anvil recesses 23, 24 (FIG. 10), with the legs 13 over the upper side of the beaded edges 6, 7 and the legs 14 under the lower side of the beaded edges 6, 7. Finally, the punches 45, 46 are forced downwardly to clinch the legs 13, 14 of the end stops 9, 10 about the beaded edges 6, 7, respectively, as shown in FIG. 11.

Although a preferred embodiment has been shown and described in detail, it should be understood that various changes and modifications can be made therein without departing from the scope of the appended claims.

What is claimed:

1. A method of attaching a pair of U-shaped end stops each having a pair of clinching legs to the respective longitudinal marginal edge portions of a pair of slide fastener stringer tapes, said method comprising the steps of:

(a) intermittently advancing the slide fastener stringer tapes lengthwise along a path of travel;

(b) delivering end stops toward the stringer tapes individually in a direction substantially normal to said path of travel with the end stop legs directed toward said path of travel;

(c) stopping the individual end stops short of said stringer tapes and retaining one of the legs of each end stop as an axis for rotation of the end stop;

(d) turning the individual end stops about one of its legs so as to place the legs of each end stop one over and the other below the longitudinal marginal edge portion of the stringer tape with spaces left between both the legs and the longitudinal marginal edge portion; and (e) clinching the legs about the longitudinal marginal edge portions while the stringer tapes are at rest.

2. A method according to claim 1, further comprising the step of forming the U-shaped end stops from a pair of blank pieces of metal.

3. A method according to claim 1, wherein the step of turning the end stops comprises turning the end stops substantially through 90 degrees about said one of their legs.

4. An apparatus for attaching a pair of U-shaped end stops each having a pair of clinching legs to the respective longitudinal marginal edge portions of slide fastener stringer tapes, said apparatus comprising:

(a) means for intermittently advancing the slide fastener stringer tapes lengthwise along a path of travel during use of the apparatus;

(b) a guide block having a pair of slots each receiving therein one of the U-shaped end stops during use of the apparatus;

(c) a pair of punches movable axially in respective ones of said slots for moving the end stops toward the slide fastener stringer tapes;

(d) a pair of shoulders extending into respective ones of said slots and each engageable with one of the legs of its associated end stop to effect turning of the end stop in response to movement thereof by one of the punches; and (e) a pair of walls each partly defining one of said slots and each having a recess contiguous to said shoulder for receiving said one of the end stop legs.

5. An apparatus according to claim 4, wherein said slots have open ends, respectively, and said shoulders being located adjacent to said open ends.

6. An apparatus according to claim 4, further including an anvil block having a pair of anvil recesses opening toward said guide block.

7. An apparatus according to claim 6, wherein said anvil block has a pair of surfaces for supporting the stringer tapes thereon with the longitudinal marginal edges of the stringer tapes being located over respective ones of said anvil recesses.

8. An apparatus according to claim 6, wherein each of said anvil recesses is less in width than the corresponding one of said slots.

9. An apparatus according to claim 4, wherein said guide block comprises a movable member having therein said pair of slots; and forming means responsive to movement of said guide block for forming within said pair of slots the end stops from a pair of blank pieces of metal.

10. An apparatus according to claim 9, wherein said forming means comprises a slide movable in a direction substantially normal to said slots, said slide having a pair of bender projections extending normally into respective ones of said slots and cooperative therewith for bending the blank pieces of metal into the U-shaped end stops in response to the movement of said guide block, and means for retracting said bender projections out of said slots in response to engagement of said slide with said guide block.

11. An apparatus for attaching a pair of U-shaped end stops each having a pair of opposed clinching legs to the respective longitudinal marginal edge portions of a pair of slide fastener stringer tapes, said apparatus comprising: means for successively advancing pairs of slide fastener stringer tapes lengthwise along a path of travel to a work station; and attaching means disposed at the work station for attaching a pair of U-shaped end stops to respective longitudinal marginal edge portions of a pair of slide fastener stringer tapes located at the work station, said attaching means comprising means defining a pair of elongate slots each disposed in spaced relationship from the marginal edge portion of respective ones of the stringer tapes located at the work station and each dimensioned to slidably receive therein one of the U-shaped end stops such that the opposed legs of the end stop are in slideable engagement with the slot wall and the ends of the legs face toward the stringer tapes, a pair of shoulders extending inwardly from the slot walls into respective ones of the slots and each configured to engage with one of the end stop legs to effect turning of the end stop about the shoulder to position the two legs of the end stop on opposite sides of the marginal edge portion of one stringer tape in response to movement of the end stop towards the stringer tape, and a pair of punches movable axially in respective ones of the slots for effecting movement of the end stops in the slots toward the stringer tapes.

12. An apparatus according to claim 11; wherein said attaching means further comprises an anvil block having a pair of recesses opening toward said pair of slots and cooperating therewith to clinch the legs of the end stops to the marginal edge portions of the stringer tapes in response to further axial movement of the punches beyond that needed to effect turning of the end stops.

13. An apparatus according to claim 11 or 12; further comprising forming means coacting with the pair of slots for forming from a pair of blank pieces of metal the pair of U-shaped end stops within the pair of slots.

14. An apparatus according to claim 11 or 12; wherein the slot walls have recessed portions adjacent the shoulders for facilitating the turning of the end stops.

* * * * *